United States Patent [19]

Baldwin

[11] 4,079,467

[45] Mar. 21, 1978

[54] PARENT-CHILD COAT

[76] Inventor: Robert O. Baldwin, 964 Meadowridge, Kirkwood, Mo. 63122

[21] Appl. No.: 702,976

[22] Filed: Jul. 6, 1976

[51] Int. Cl.[2] ..... A41D 1/00

[52] U.S. Cl. ..... 2/94; 224/6

[58] Field of Search ..... 2/94, 85, 93, 104, 105, 2/253, 108, 248, 249, 69, 87; 224/6, 12

[56] References Cited

U.S. PATENT DOCUMENTS

| | | | |
|---|---|---|---|
| 314,333 | 3/1885 | Heller | 2/94 X |
| 2,072,030 | 2/1937 | Damron | 2/87 |
| 2,661,475 | 12/1953 | Auslender | 2/108 |
| 2,879,514 | 3/1959 | Shapiro | 2/69 |
| 3,085,254 | 4/1963 | Cutler | 2/247 |
| 3,841,543 | 10/1974 | Bolton | 224/6 |

FOREIGN PATENT DOCUMENTS

| | | | |
|---|---|---|---|
| 109,921 | 10/1917 | United Kingdom | 224/6 |

*Primary Examiner*—Doris L. Troutman
*Attorney, Agent, or Firm*—Grace J. Fishel

[57] ABSTRACT

A coat for providing an integral covering for a person wearing the coat and for a baby carried by said person, the coat having an expandable portion communicating with the inside of the coat for accommodating the baby.

9 Claims, 8 Drawing Figures

PARENT-CHILD COAT

This invention relates to an integral parent-child coat for use by a wearer carrying a child, said coat passing as generally ordinary when the wearer is not carrying a child.

It requires effort to dress a baby for the outdoors in cold weather and even when properly dressed, it is difficult to keep it warm. Most people have observed that it is no easy matter to place a wiggling baby in a snowsuit or the like. For this reason, buntings and sacks without legs or sleeves are often used. While these garments ease the problems in dressing the baby, they do not assure that it will be kept warm.

When the baby's diaper must be changed, the baby must be undressed and the effort of dressing it undergone again. When the baby is dressed, it is difficult for the parent to check to see if it is warm.

In view of the above, it is seen that there is a need for a means for readily dressing and undressing a baby for the outdoors which does not require extra effort by the parent other than that in putting his own coat on. It is also seen that there is a need for a means to provide for transfer of heat from the parent to the child and a means to make it easy for the parent to check if the child is cold.

Therefore, among the several objects of the present invention may be noted the provision of a parent-child coat which provides an integral covering for both parent and child. Another object is to provide a coat which readily permits transfer of body heat from the parent to the child and which allows the parent to monitor the child's condition. Still another object is to facilitate readying the child for the outdoors without requiring the parent to dress the child specially. Other objects and features will be in part apparent and in part pointed out hereinafter.

The invention accordingly comprises the constructions hereinafter described, the scope of the invention being indicated in the subjoined claims.

In the accompanying drawings, in which several of various possible embodiments of the invention are illustrated, corresponding reference characters indicate corresponding parts throughout the several views of the drawings.

Figure 1:
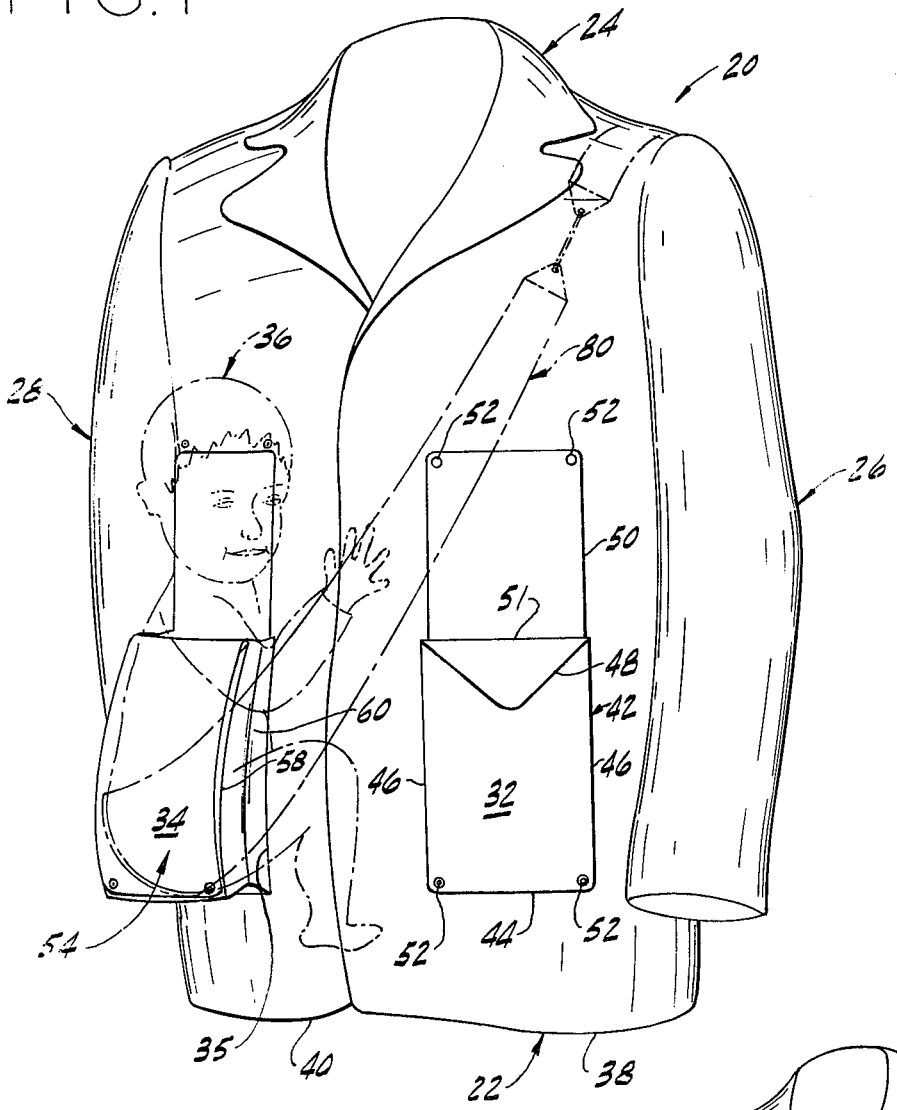
FIG. 1 is a front perspective view illustrating a parent-child coat in accordance with the present invention.

Referring to the figures, reference numeral 20 designates generally a parent-child coat made in accordance with the present invention. Coat 20 has a somewhat conventional outer appearance and includes a torso portion 22 with a collar 24 and with right and left (as viewed in the figures) sleeves 26 and 28, respectively. The front of torso portion 22 is releasably closed by bottons 30 or the like.

Torso portion 22 is further provided with right and left pockets 32 and 34, respectively. Left pocket 34 covers an elongated cut-out 35 in torso portion 22 and is expandable as more particularly described hereinafter to accommodate a child 36 carried by the wearer (not shown) under the coat.

Figure 3:
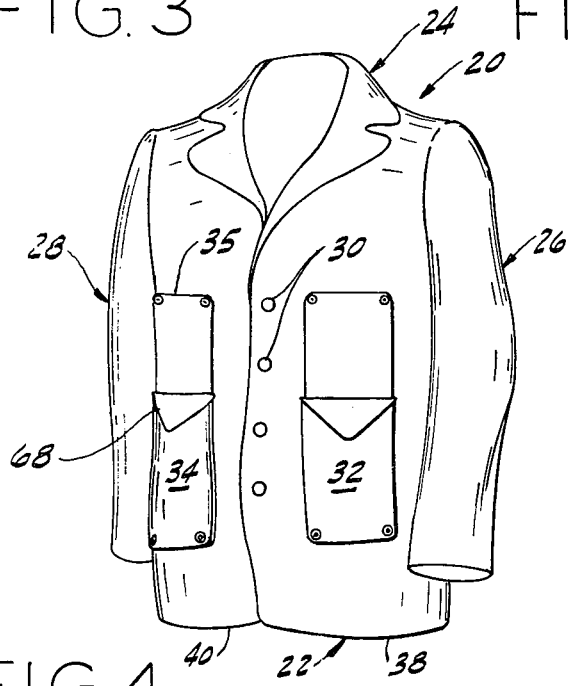
FIG. 3 is a view similar to FIG. 2 but showing the coat as worn without a child.

As best seen in FIG. 3, pockets 32 and 34 are elongated and extend generally vertically on right and left portions 38 and 40, respectively, of torso portion 22. Right pocket 32 is formed from a generally rectangular piece of fabric 42 which is stitched to right portion 38 of torso 22 along a bottom edge 44 and side edges 46 thereof. It includes a decorative flap 48 and is ornamented with a patch 50. Flap 48 depends downwardly from an open end 51 of the pocket and patch 50 is stitched to portion 38 and extends upwardly behind open end 51 for a distance substantially the length of fabric 42. Patch 50 is rectangular in configuration and designed to balance the appearance of pocket 34 as shown in FIG. 3. Further to this end, pocket 32 has four decorative studs 52 to balance the appearance of this pocket with pocket 34 described below.

Figure 2:
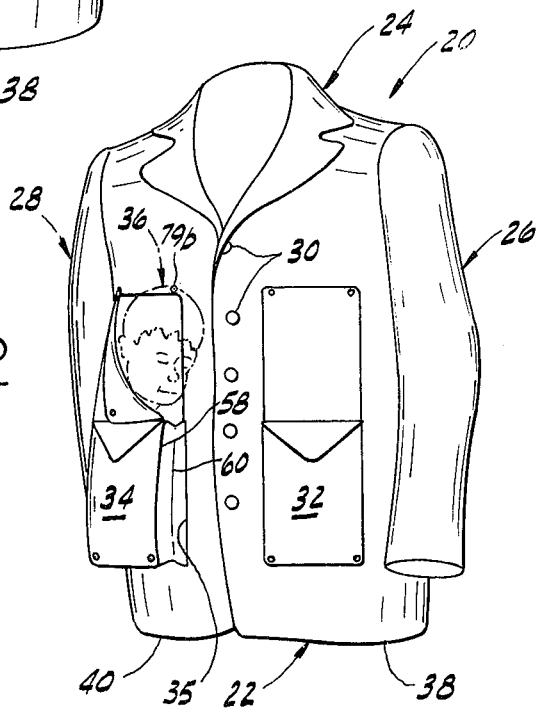
FIG. 2 is a view similar to FIG. 1 but reduced in size and showing the baby's head partially covered.
Figure 4:
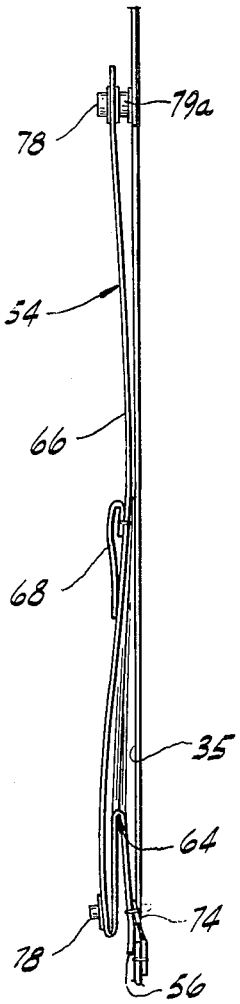
FIG. 4 is an enlarged longitudinal cross-sectional view of the expandable pocket for covering the child as shown in FIG. 3, taken at the midpoint of the pocket.
Figure 5:
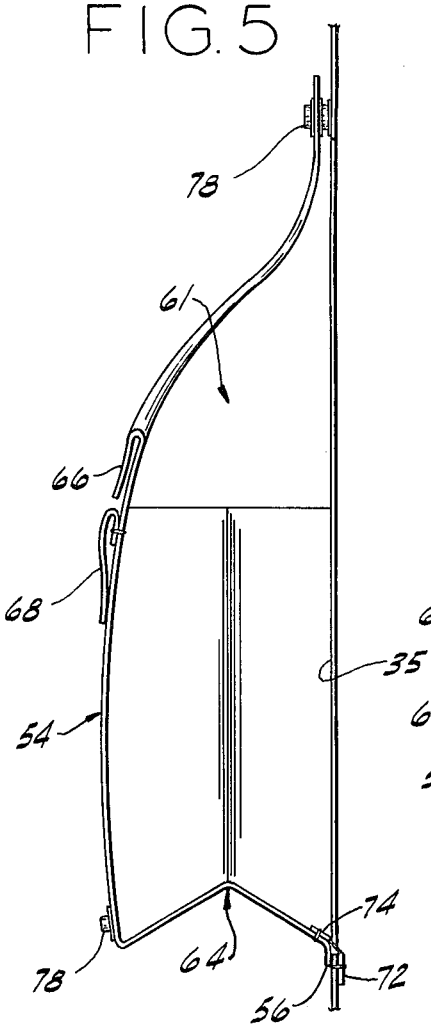
FIG. 5 is a view similar to FIG. 4 except showing the pocket as shown in FIG. 2.
Figure 6:
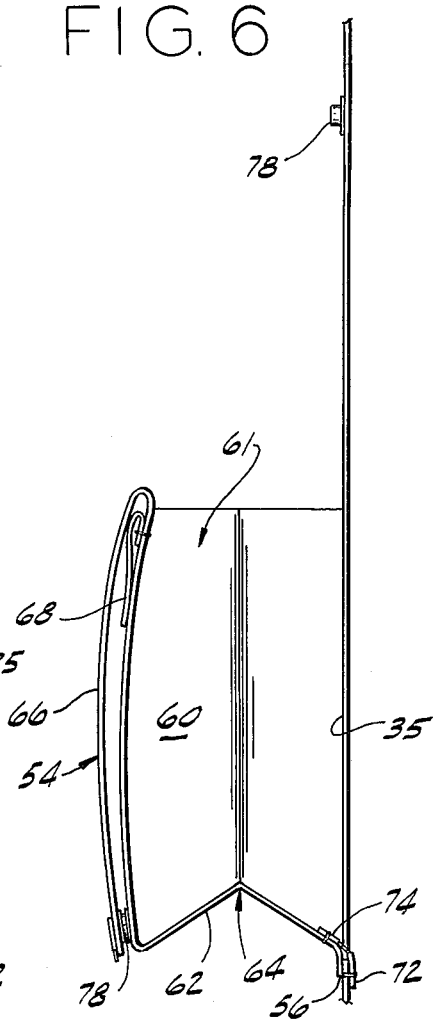
FIG. 6 is a view similar to FIG. 5 except showing the pocket as shown in FIG. 1.

Referring now to FIGS. 4–6, left pocket 34, like right pocket 32, is formed from a generally rectangular piece of fabric 54 which is attached to left portion 40 of torso 22 along a bottom edge 56. The bottom ends of opposite side edges 58 are stitched to generally elongated strips 60 along meeting longer and shorter edges thereof as best seen in FIGS. 1 and 2. The opposite longer side edge of strips 60 is in turn attached to left portion 40 of torso 22. The means by which bottom edge 56 and strips 60 are attached to portion 40 are described more particularly below. So attached, fabric 54 and strips 60 are seen to form a generally box-shaped pouch 61.

As illustrated in FIGS. 4—6 and FIGS. 1 and 2, strips 60 provide extra fullness in pocket 34 to accommodate child 36. Expansion may be accomplished without strips 60 if fabric 54 is formed of elasticized material. Referring to FIG. 4, when pocket 34 is not in use strips 60 and a bottom portion 62 of fabric 54 attached thereto permit the pocket to fold flat along V-folds 64.

Pouch 61 is substantially as long as pocket 32 and upper portion 66 of fabric 54 is substantially twice as long as the pocket is deep. A decorative flap 68 is provided transverse fabric 54 substantially midway the length of upper portion 66 of fabric 54 and is stitched on the outside thereof.

Pocket 34 is sized to cover elongated cut-out 35 and can be attached to the coat by means of a zipper 70 as shown in FIGS. 4–7. Referring to these figures, a zipper track 72 is stitched around the lower portion of the periphery of cut-out 35. A mating zipper track 74 is stitched to pocket 34.

Figure 7:
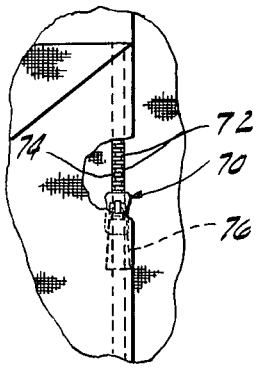
FIG. 7 is an enlarged fragmentary front elevational view showing details for the attachment of the child accommodating pocket to the coat.

For the purpose intended, zipper 70 is preferably separable, e.g. a jacket type zipper. Zipper pull 76 shown in FIG. 7 is started at the right upper corner of pocket 34 adjacent flap 68. It is then zipped down the right side of the pocket (along the free longer edge of right strip 60), across the bottom (along bottom edge 56) and up the left side (along the free longer edge of left strip 60) to the opposite side of flap 68. So attached, pocket 34 is in the condition shown in FIGS. 1 and 6.

The free end of upper portion 66 of fabric 54 is bent downwardly and hangs freely. To prevent this end from flapping, cooperative snaps 78 are provided on the outside of the pocket for use as shown in FIG. 6. The upper pair of snaps 78 are double sided for use as described below.

In use as a parent-child coat, the wearer first places child 36 in a suitable carrier 80. Carrier 80 as shown is not part of the present invention and other suitable carriers (not shown) may be substituted for the particular carrier shown. Similarly, carrier 80 may optionally (not shown) be formed as an integral part of coat 20. In any case, the function of the carrier is to transfer the weight of child 36 to the back and shoulders of the wearer. The carrier makes it possible for the wearer to carry the child without weighing down pocket 34 and leaves the wearer's hands and arms free.

With child 36 in carrier 80, the wearer then puts coat 20 on in the usual manner but taking care that child 36 is aligned with pocket 34. Since cut-out 35 communicates the inside of pocket 34 with the inside of coat 20, child 36 is fitted into pouch 61 as shown in FIG. 1.

If it is desired to partially cover the head of child 36, the free end of upper portion 66 of fabric 54 is freed from snaps 78. The left member of double sided snaps 78 is then snapped to a cooperatively mating left coat snap **79*a* provided on the coat adjacent the upper left corner of cut-out 35. So done, the child's head is partially cradled by fabric 54 as shown in FIG. 2**.

If it is desired to completely cover the child's head, the right member of double sided snaps 78 is snapped to a right coat snap **79*b* provided adjacent the upper right corner of cut-out 35**.

As shown in FIG. 3, the wearer may use coat 20 without child 36. In which case, double sided snaps are snapped to coat snaps **79*a* and 79*b* as described above. Without child 36, pocket 34 is folded flat against torso 22 into the condition shown in FIG. 4. So folded, coat 20** is generally normal in appearance and passes for an ordinary coat.

In view of the above, it will be seen that the several objects of the invention are achieved and other advantageous results attained.

Figure 8:
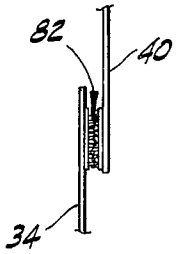
FIG. 8 is an enlarged fragmentary longitudinal cross-sectional view showing alternate details for attaching the pocket to the coat.

As various changes could be made in the above constructions without departing from the scope of the invention, it is intended that all matter contained in the above description or shown in the accompanying drawings shall be interpreted as illustrative and not in a limiting sense. For example, as shown in FIG. 8, the attachment means for pocket 34 may comprise a hook and loop fastener 82 such as is commonly sold under the trademark VELCRO. So used, cooperative portions of fastener 82 are positioned for use as described for zipper 70. Or, if desired, pocket 34 may be stitched directly to torso 22.

When pocket 34 is detachable by means of zipper 70 or VELCRO fastener 82, coat 20 may be provided with an alternate pocket 34 (not shown). Alternate pocket 34 is constructed like pocket 32 except that patch 50 continues behind fabric 42 for the length thereof. Cooperative attachment means such as zipper track 74 are provided around the edges of the pocket and patch 50 is provided with double sided snaps 78 so that it may be attached to torso portion 22 like free end of fabric 54 to cover cut-out 35.

As will be appreciated, pocket 34 cannot be used in the ordinary manner since cut-out 35 communicates the pocket with the inside of the coat as aforementioned. Alternate pocket 34, on the other hand, can be used in the ordinary manner and is provided for that purpose.

What is claimed is:

1. A coat for providing an integral covering for a person wearing the coat and for a baby carried by said person having a first front torso portion with an aperture to receive said baby freely therethrough, a first panel joined to said first torso portion along the periphery of said aperture, a second panel joined to a second torso portion, said first panel symmetrical on said first torso portion with respect to said second panel on said second torso portion, said first torso portion further including expansion means for expanding said first panel whereby said coat provides the covering for said person and said first panel provides the covering integral therewith for said baby, said first panel appearing substantially identical to said second panel when said expansion means are unexpanded.

2. The coat according to claim 1 wherein the first panel is partially joined to the first torso portion along the periphery of the aperture, said first panel and the first torso portion forming a slit along that portion of the first torso portion wherealong the first panel is free from said first torso portion, said slit adapted to receive a head of the baby.

3. The coat according to claim 2 wherein the first panel includes a flap for covering said slit.

4. The coat according to claim 3 wherein the flap has double sided fasteners for securing the flap to said first panel when not required over the slit and for securing the flap to the coat when required over the slit.

5. The coat according to claim 2 wherein the first panel is detachably joined to said first torso portion.

6. The coat according to claim 5 wherein the first panel is detachably joined to the first torso portion by zipper means.

7. The coat according to claim 5 wherein the first panel is detachably joined to the first torso portion by hook and loop fastener means.

8. The coat according to claim 4 which further includes child supporting means adapted to support the baby in alignment with said aperture in said first torso portion.

9. The coat according to claim 8 wherein the child supporting means are separable from the coat when not required.

* * * * *